US005731696A

United States Patent [19]

Pennisi et al.

[11] Patent Number: 5,731,696

[45] Date of Patent: Mar. 24, 1998

[54] VOLTAGE REFERENCE CIRCUIT WITH PROGRAMMABLE THERMAL COEFFICIENT

[75] Inventors: Alessio Pennisi, Milan; Fabio Marchio, Sedriano, both of Italy; Jean Marie Pierret; Francois Brandy, both of Saint-Quen Cedex, France

[73] Assignee: SGS-Thomson Microelectronics S.r.l., Agrate Brianza, Italy

[21] Appl. No.: 537,340

[22] Filed: Jul. 24, 1995

(Under 37 CFR 1.47)

Related U.S. Application Data

[63] Continuation of Ser. No. 267,199, Jun. 29, 1994, abandoned.

[30] Foreign Application Priority Data

Jun. 30, 1993 [EP] European Pat. Off. ..... 93830285

[51] Int. Cl.[6] ..... G05F 3/16

[52] U.S. Cl. ..... 323/313; 327/539; 323/315

[58] Field of Search ..... 323/313, 315, 323/907; 327/513, 539

[56] References Cited

U.S. PATENT DOCUMENTS

| | | | |
|---|---|---|---|
| Re. 30,586 | 4/1981 | Brokaw | 323/314 |
| 3,908,162 | 9/1975 | Marley et al. | 323/19 |
| 4,673,866 | 6/1987 | Masuda | 323/313 |
| 4,751,454 | 6/1988 | Dielacher et al. | 323/314 |
| 4,789,819 | 12/1988 | Nelson | 323/907 |
| 5,053,640 | 10/1991 | Yum | 327/539 |
| 5,241,261 | 8/1993 | Edwards et al. | 323/313 |
| 5,352,973 | 10/1994 | Audy | 323/313 |
| 5,440,224 | 8/1995 | Kimura | 323/313 |
| 5,621,308 | 4/1997 | Kadanka et al. | 323/315 |
| 5,631,551 | 5/1997 | Scaccianoce et al. | 323/313 |

FOREIGN PATENT DOCUMENTS 2 007 055 5/1979 United Kingdom .

OTHER PUBLICATIONS

European Search Report from European Patent Application 93830285.8, filed Jun. 30, 1993.

*Primary Examiner*—Stuart N. Hecker

*Attorney, Agent, or Firm*—Wolf, Greenfield & Sacks, P.C.; James H. Morris

[57] ABSTRACT

A voltage reference circuit with programmable thermal coefficient, comprising first and second bipolar transistors having their base terminals connected together and collector terminals connected to two legs of a current mirror circuit. The emitter terminal of the first transistor is connected to ground through two resistors in series with each other, and the emitter terminal of the second transistor is connected to a node between the two resistors. The emitter of at least one of the two transistors has discrete portions adapted to be connected electrically together in a predetermined fashion.

30 Claims, 9 Drawing Sheets

VOLTAGE REFERENCE CIRCUIT WITH PROGRAMMABLE THERMAL COEFFICIENT

CROSS-REFERENCE TO RELATED APPLICATIONS

This application is a continuation of application Ser. No. 08/267,199, filed Jun. 29, 1994 now abandoned.

BACKGROUND OF THE INVENTION

1. Field of the Invention

This invention relates to voltage reference circuits, and more particularly to voltage reference circuits for use in voltage regulating devices.

2. Discussion of the Related Art

Generally speaking, voltage regulators are designed to keep the voltage that they make available at their output terminals within one or more predetermined values, i.e., the output voltage must remain constant when the input voltage value varies, as a function of discrete ranges of fluctuation of the input voltage value.

Any variations in value of the output voltage ought to be an exact function of the system variables, such as the input voltage, the load applied to the output, and temperature.

Such variations should be insignificant throughout the service range.

In the automotive industry, voltage regulators are used to supply charging voltages to vehicle batteries.

In view of the widely varying environmental conditions in which motor vehicles are used, operating temperature is a factor of primary concern in designing the circuitry of voltage regulating devices, especially monolithically integrable ones.

Individual automobile manufacturers adopt different methods of determining the voltage value versus temperature, and in fact, some of them charge the battery at a lower voltage when temperature goes up to ensure longer life for the battery, while others select a lower voltage at room temperature and charge the battery at a voltage unrelated to temperature.

Thus, the voltage available at the output terminals (Vout) of a voltage regulator for automotive applications may be expressed, at a given temperature, as $$Vout=Vamb+K(T-Tamb) \quad (1)$$

where Vamb and Tamb represent the room temperature voltage and temperature, respectively, T represents the actual temperature and K is a constant, and Vamb and K vary between individual automobile manufacturers.

An outstanding aspect of any voltage regulator design is its reference voltage. Monolithically integrated voltage regulators quite frequently use a the bandgap type reference.

Shown in FIG. 1 of the drawings is, in fact, a circuit diagram for a bandgap reference used in voltage regulators for automotive applications.

The main elements in said diagram are the transistors Q1 and Q2 having their base terminals connected together, a current mirror formed by transistors Q3 and Q4 wherein constant currents flow through the collectors of such transistors, and two resistors R1 and R2 which determine the thermal drift of the output voltage from the bandgap reference.

The portion of the circuit which includes the transistors Q5, Q6, Q7 and Q8 is an operational amplifier effective to accurately determine, in combination with resistors R5 and R6, the absolute value of the output voltage at a given operating temperature.

Assuming equal collector currents for Q1 and Q2, the output voltage is, $$Vout=VbeQ2+(VbeQ2-VbeQ1)*2*R2/R1 \quad (2)$$

$$VbeQ2-VbeQ1=V_T ln(A2)-V_T ln(A1)=V_T ln(A2/A1) \quad (3)$$

$$Vout=VbeQ2+V_T ln(A2/A1)*2*R2/R1 \quad (4)$$

where VbeQ1 and VbeQ2 represent the voltage across the emitter and the control gate of transistors Q1 and Q2, respectively; R1 and R2 represent the resistance values of resistors R1 and R2, respectively A1 and A2 represent the emitter area regions of transistors Q1 and Q2, respectively; and $V_T$ is a constant.

The first addend in Equation (4) has a negative derivative (=−2mV/*C), whereas the second addend derivative is more or less positive (=0.2V/°C*2 R2/R1). To change the temperature gradient of Vout, it is common practice to change the value of either resistor R1 or R2.

This method is used because it is notionally immediate and is effective.

However, it also involves the problems of integration area with monolithically integrated regulators, and hence higher designing costs.

In fact, the two resistors R1 and R2 are constructed to provide the utmost in accuracy, and are much wider than the least width in order to minimize the effect of lateral diffusion, with larger contact heads to minimize the offset brought about by contact resistance.

The bulk of such resistors is usually considerable and it is even more considerable when several resistors with different values are provided in the device to ensure programmability of the thermal coefficient by different automobile manufacturers.

SUMMARY OF THE INVENTION

An object of this invention is, therefore, to provide an internal bandgap voltage reference with a programmable thermal coefficient whose overall integration area can be significantly reduced without impairing its accuracy.

A first embodiment includes a monolithically integrated voltage reference circuit comprising first and second transistors, each having first and second terminals and a control terminal, first and second constant current generators and first and second resistors connected in series to each other and between the first terminal of the first transistor and a first terminal of a voltage supply generator, the first terminal of the second transistor being connected to a link node between the two resistors, the first constant current generator being connected between a second terminal of the voltage supply generator and the second terminal of the first transistor, the second constant current generator being connected between the second terminal of the voltage supply generator and the second terminal of the second transistor, and the control terminal of the first transistor being connected to the control terminal of the second transistor, wherein the configuration of at least one of said first and second transistors is programmable.

Another embodiment includes having the first embodiment with the first and second transistors being bipolar, and the configuration of the emitter region of at least one of said first and second transistors being programmable.

Another embodiment includes having the first embodiment with a resistor being connected between the control terminals of the first and second transistors.

Another embodiment includes having the first embodiment with the emitter region of at least one of said first and second transistors including discrete portions adapted to be connected electrically together in a predetermined fashion.

Another embodiment includes having the first embodiment with the constant current generators being legs of a current mirror circuit structure.

Yet another embodiment includes a monolithically integrated voltage reference circuit comprising first and second transistors, each having first and second terminals and a control terminal, first and second constant current generators and first and second resistors connected in series to each other and between the first terminal of the first transistor and a first terminal of a voltage supply generator, the first terminal of the second transistor being connected to a link node between the two resistors, the first constant current generator being connected between a second terminal of the voltage supply generator and the second terminal of the first transistor, the second constant current generator being connected between the second terminal of the voltage supply generator and the second terminal of the voltage supply generator and the second terminal of the second transistor, and the control terminal of the first transistor being connected to the control terminal of the second transistor, characterized in that the first and second constant current generators respectively comprise third and fourth transistors respectively connected to the first and second transistors, and that the configuration of at least one of said third and fourth transistors is programmable.

Additionally, another embodiment includes the previous embodiment with the third and fourth transistors being bipolar, and the configuration of the emitter region of at least one of said third and fourth transistors being programmable.

Each of the embodiments mentioned above can be incorporated a traditional voltage regulator system. Moreover, each embodiment can be further integrated into a monolithically integrated voltage regulator.

BRIEF DESCRIPTION OF THE DRAWINGS

The features and advantages of a circuit according to the invention will become apparent from the following description of an embodiment thereof, given by way of example and not of limitation in relation to FIG. 1.

DETAILED DESCRIPTION

The invention stands on the fact that the variation of the positive gradient is determined in Equation (4) by the term, $$V_T \ln(A2/A1)*2*R2/R1$$

and therefore, the temperature increase is not only affected by the ratio of the two resistors R1 and R2, but also by that of the two areas of transistors Q2 and Q1.

Figure 1:
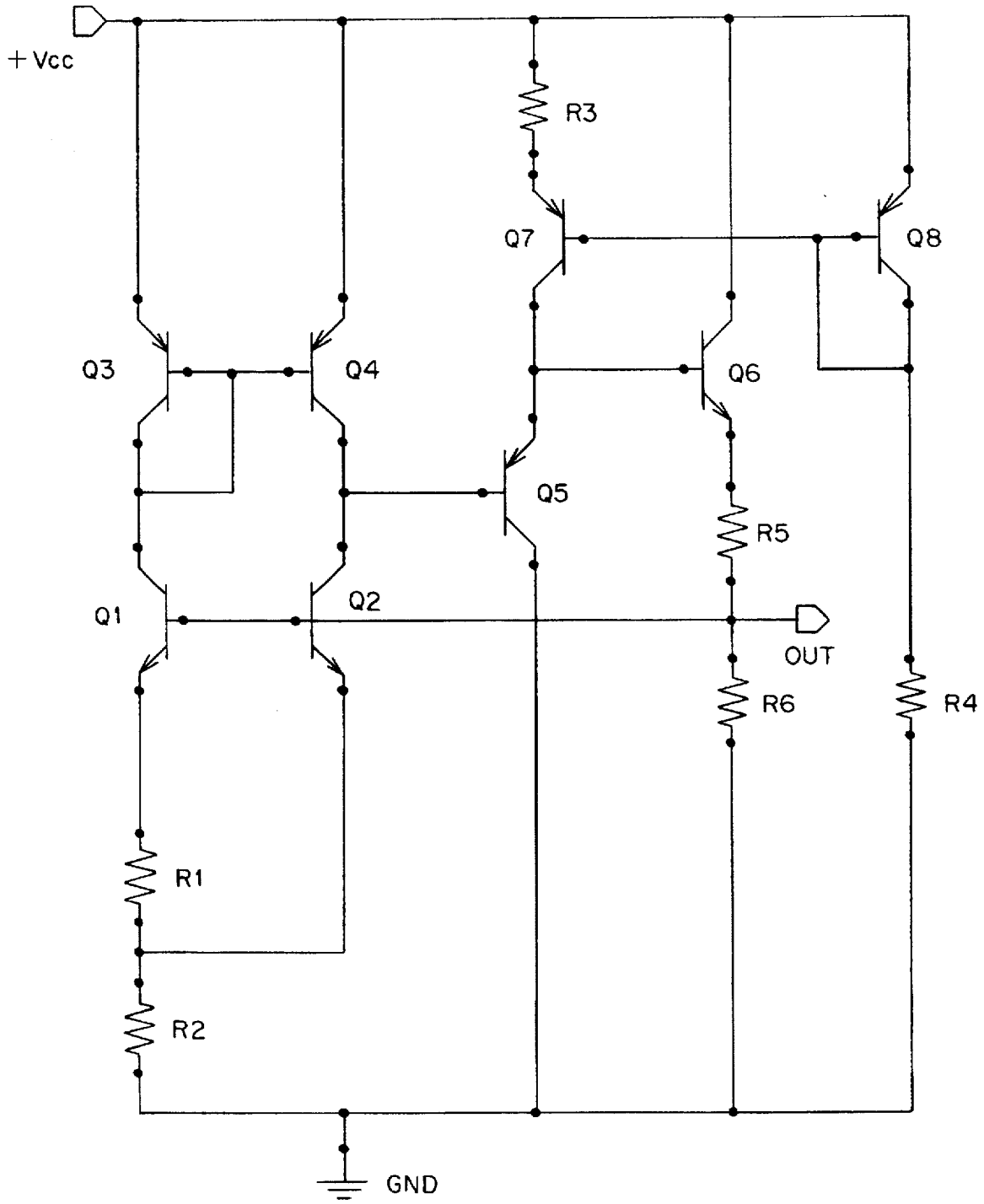
Fig. 1 (PRIOR ART)
FIG. 1 shows a circuit diagram for a bandgap voltage reference with programmable thermal coefficient, known in the prior art and to which this invention can be applied.
Figure 2:
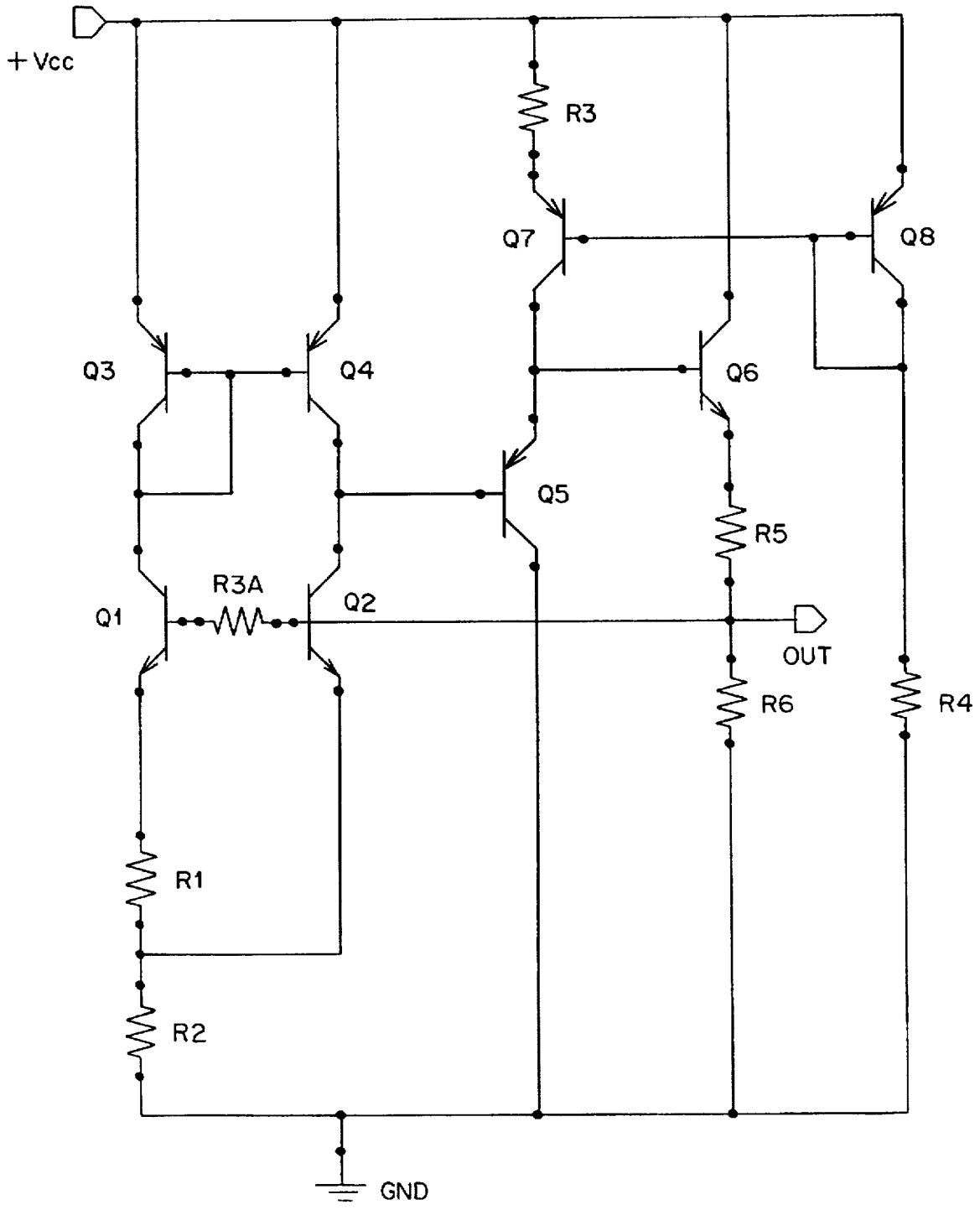
FIG. 2 shows a circuit diagram of a voltage reference circuit with programmable thermal coefficient of another embodiment of the invention, wherein a resistor is added between the control terminals of Q1 and Q2.
Figure 3:
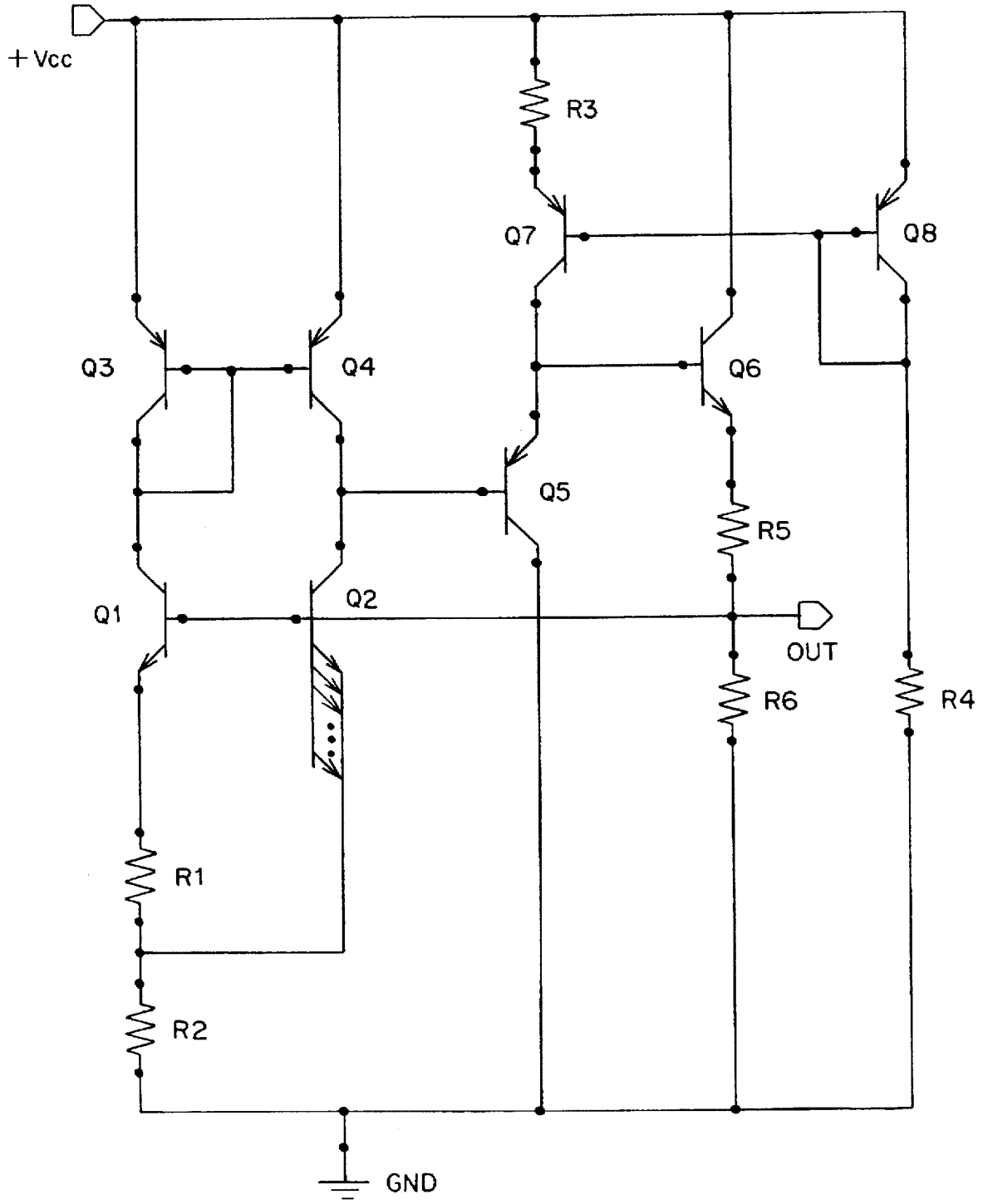
FIG. 3 shows a circuit diagram of a voltage reference circuit with programmable thermal coefficient of another embodiment of the invention, wherein transistor Q2 has a plurality of discrete emitter area portions.
Figure 5:
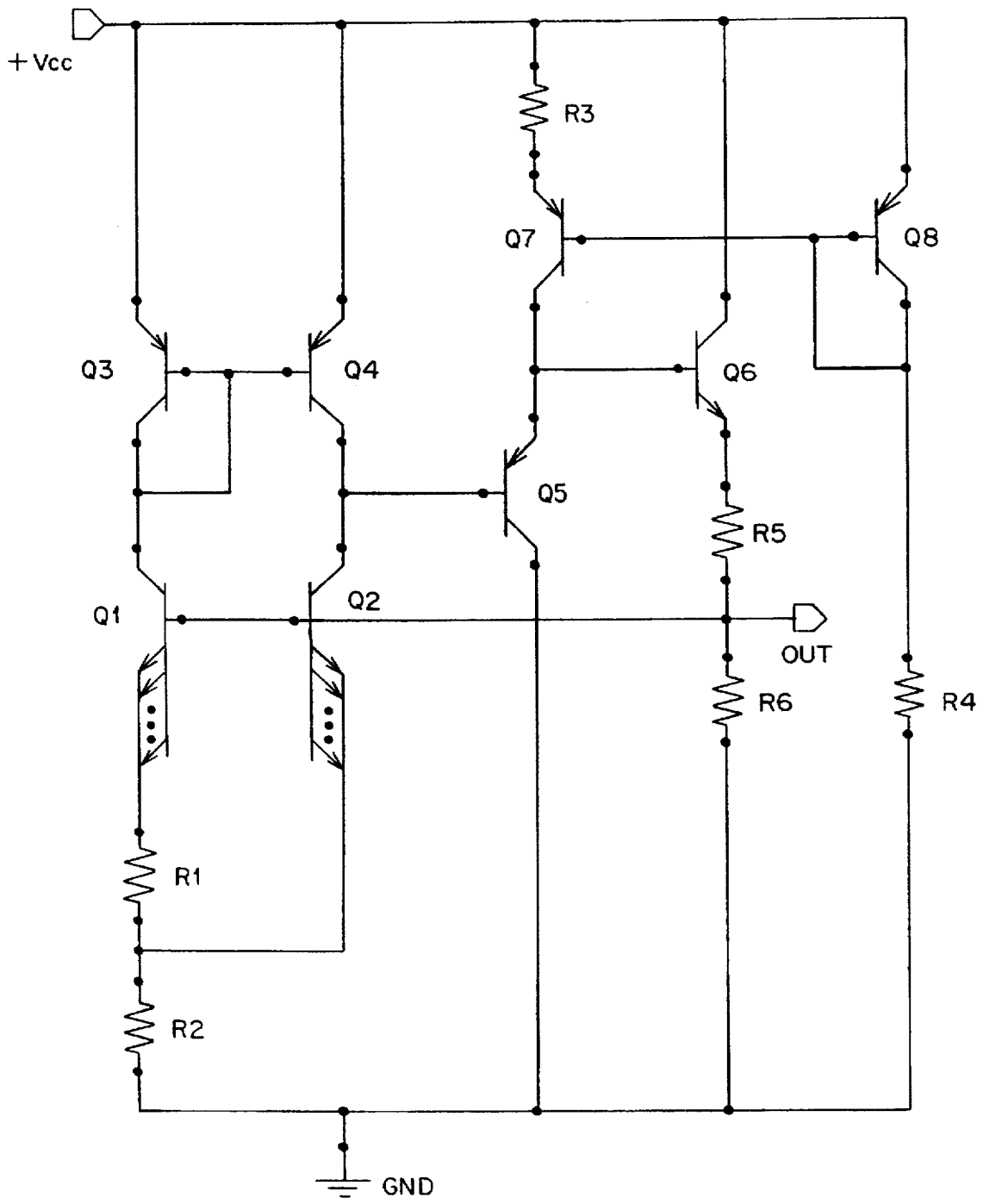
FIG. 5 shows a circuit diagram for a voltage reference circuit with programmable thermal coefficient of another embodiment of the invention, wherein both transistors Q1 and Q2 have a plurality of discrete emitter area portions.

FIGS. 3 and 5 consist of providing a monolithically integrated voltage reference circuit to the same diagram as shown in FIG. 1 of the drawings, or a similar one, with a stage of a type which comprises the structure including transistors Q1, Q2, Q3, Q4 and resistors R1 and R2, wherein the thermal coefficient programmability is achieved by providing plural discrete emitter areas for the transistors Q1 and/or Q2.

The manufacture of the integrated circuit device provides a customized connection fixture for the individual purchaser of the product, whereby different emitter areas are connected together in a predetermined fashion to yield predetermined values of the overall emitter area for either or both of the transistors Q1 and Q2.

This connecting operation is necessary with the programming method based on changing resistive values, and therefore, does not add further costs.

The number of gradients to be obtained is equal to the product of the number of obtainable values by the areas of the two transistors.

Figure 4:
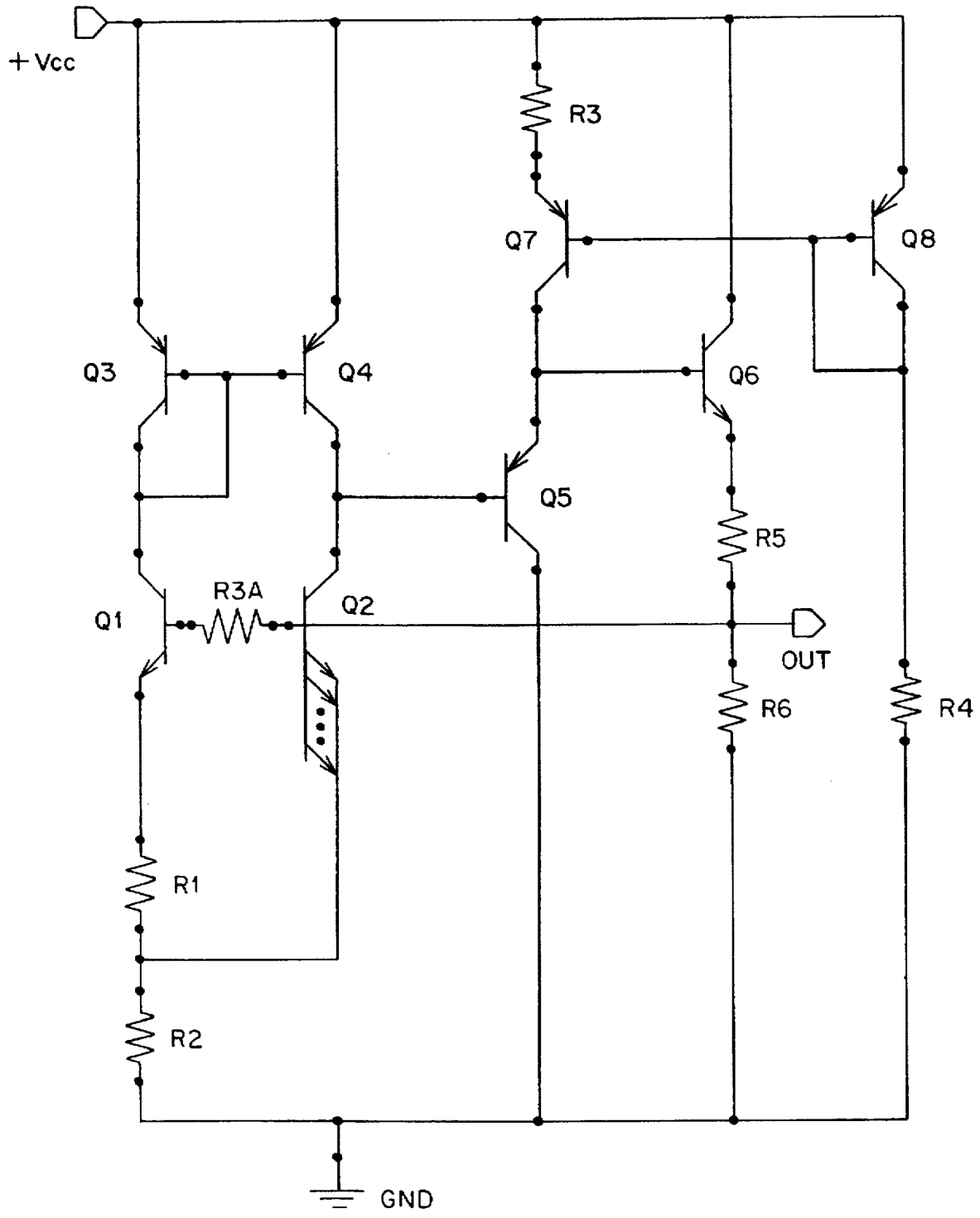
FIG. 4 shows a circuit diagram for a voltage reference circuit with programmable thermal coefficient of another embodiment of the invention, wherein a resistor is added between the control terminals of Q1 and Q2, and transistor Q2 has a plurality of discrete emitter area portions.
Figure 6:
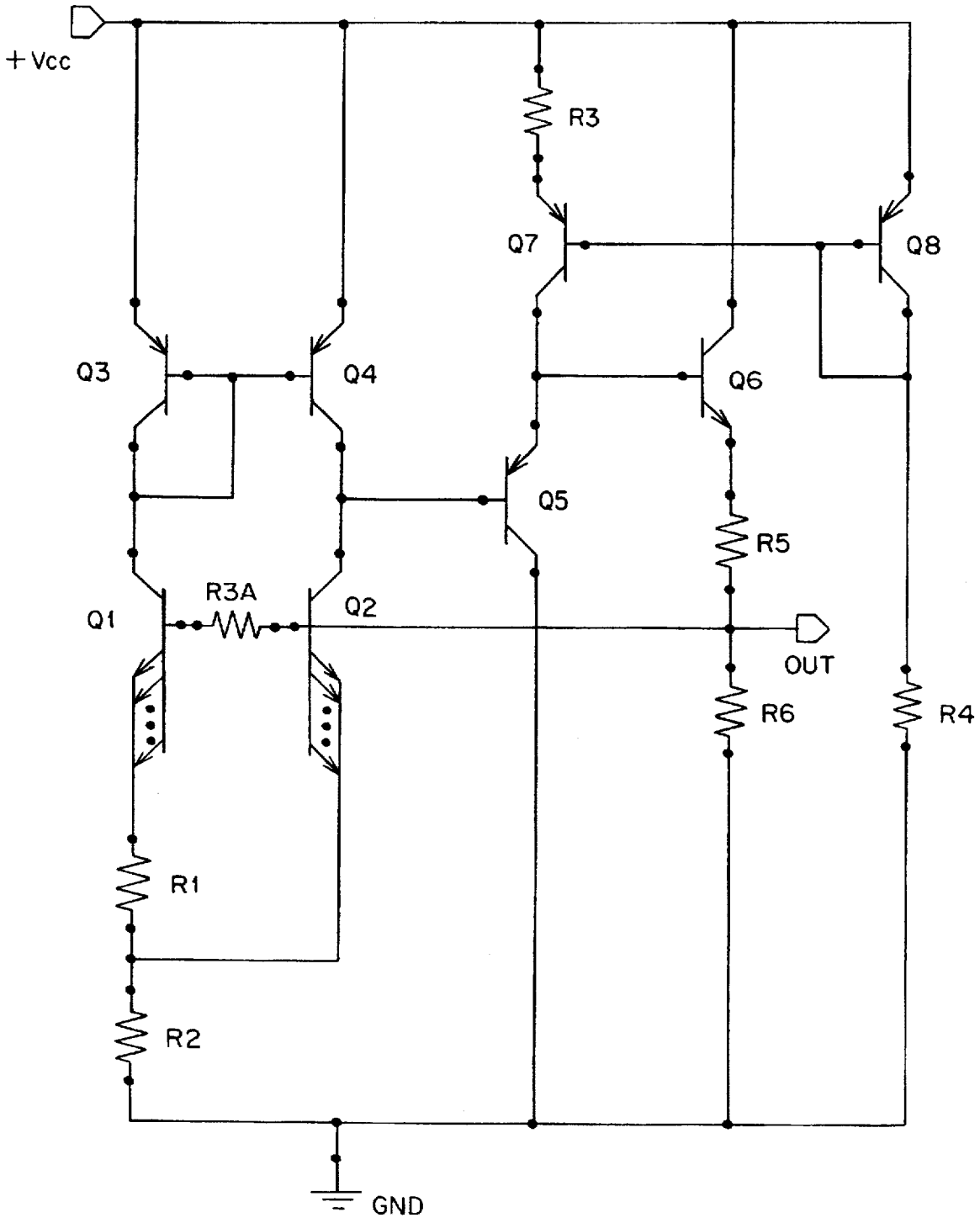
FIG. 6 shows a circuit diagram for a voltage reference circuit with programmable thermal coefficient of another embodiment of the invention, wherein both transistors Q1 and Q2 have a plurality of discrete emitter area portions and a resistor is added between the control terminals of Q1 and Q2.

To get any specific gradient, more or less emitter areas are interconnected. Possible increases or decreases in the output voltage Vout may be adjusted through the resistors R5 and R6, as in prior art devices. As in FIGS. 4 and 6, one embodiment of the invention adds a resistor R3A between the control terminals of the transistors Q1 and Q2.

In any case, by working on the emitter areas of transistors rather than on integrated resistors, the bulk can be greatly reduced, with significant advantages in terms of integration area and convenience of design and configuration.

Furthermore, the number of gradients which can be provided is increased with no added cost and with no prejudice for the accuracy of the circuit.

It will be appreciated that many modifications or integrations may be made on the above-described embodiment without departing from the protection scope of the appended claims.

For example, a pair of constant current generators could be substituted for the current mirror circuit with the transistors Q3 and Q4.

Figure 7:
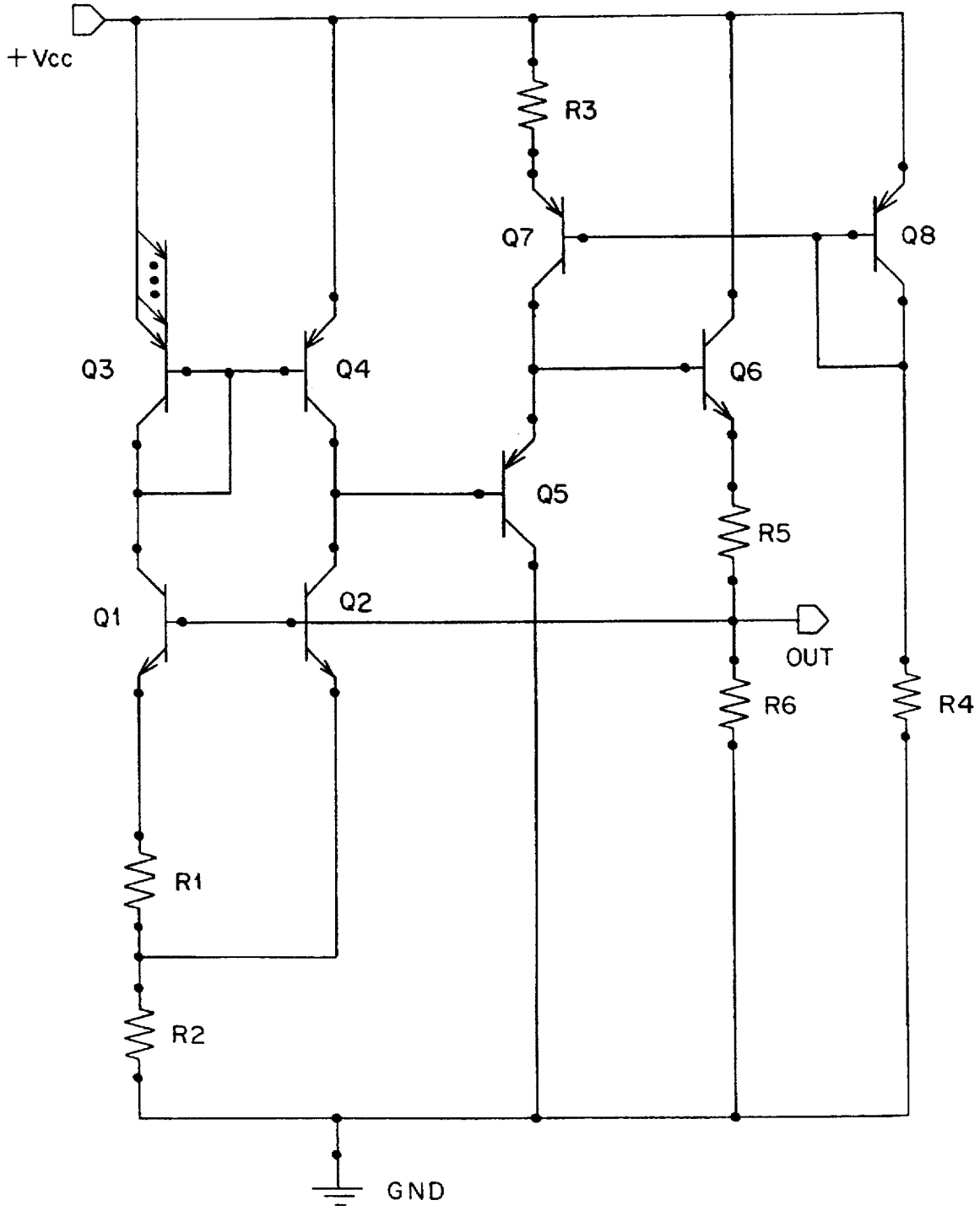
FIG. 7 shows a circuit diagram for a voltage reference circuit with programmable thermal coefficient of another embodiment of the invention, wherein one transistor in a constant current generator, Q3, has a plurality of discrete emitter area portions.
Figure 8:
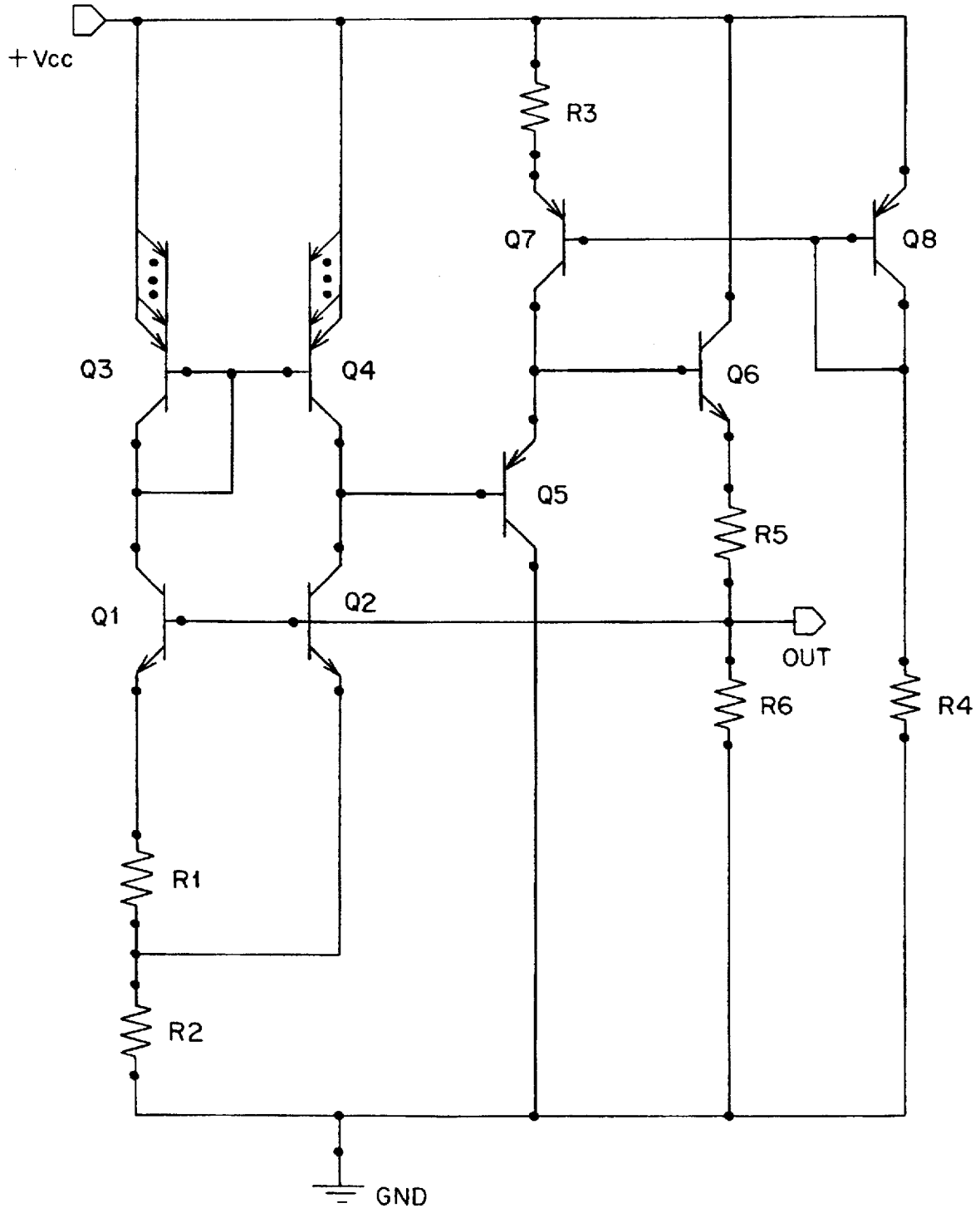
FIG. 8 shows a circuit diagram for a voltage reference circuit with programmable thermal coefficient of another embodiment of the invention, wherein both transistors in the constant current generator, Q3 and Q4, have a plurality of discrete emitter area portions.
Figure 9:
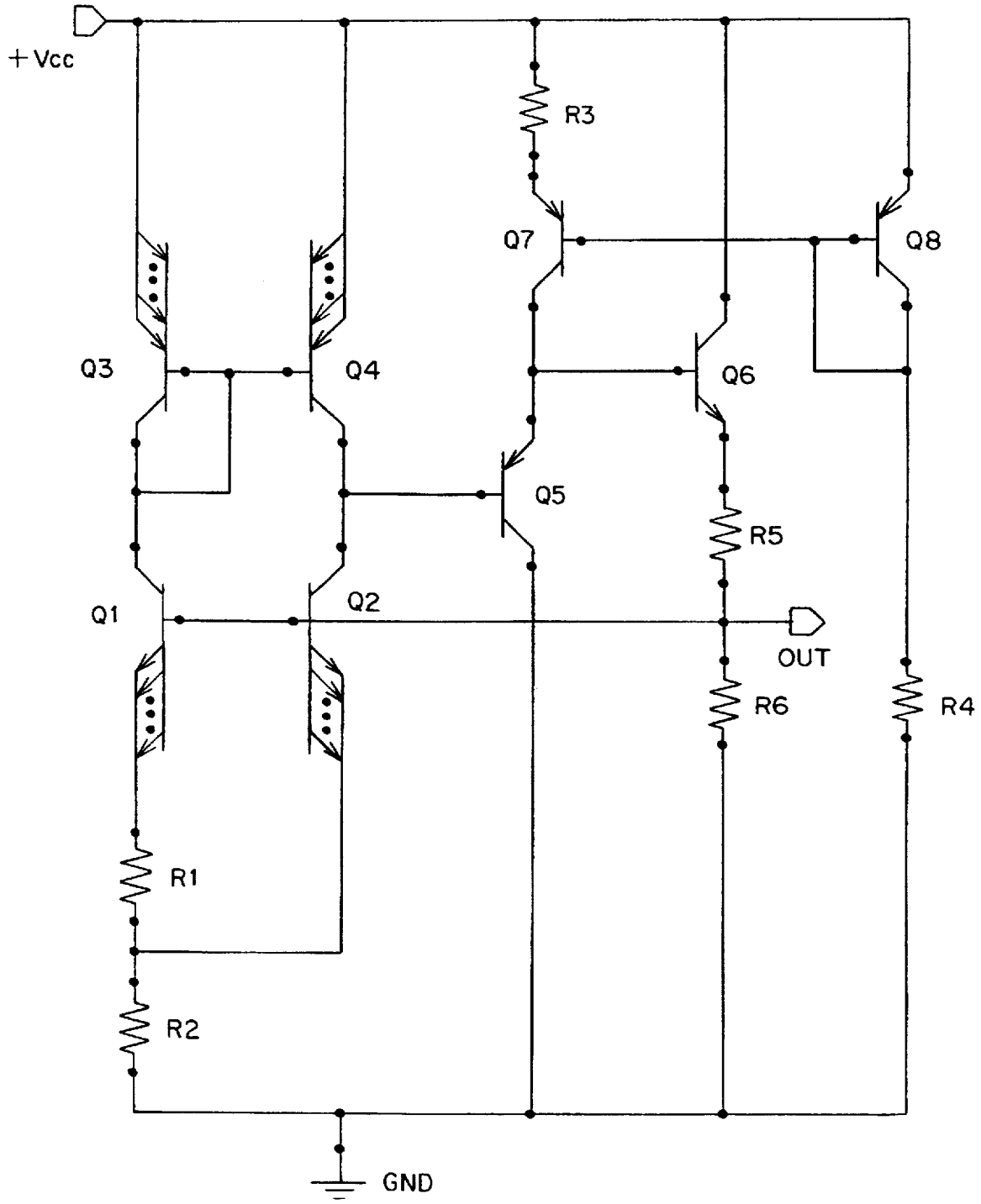
FIG. 9 shows a circuit diagram for a voltage reference circuit with programmable thermal coefficient of another embodiment of the invention, wherein transistors Q1, Q2, Q3, and Q4 all have a plurality of discrete emitter area portions.

Alternatively as in FIGS. 7 and 8, the emitter area variability could be provided for the transistors Q3 and/or Q4 instead of transistors Q1 and Q2. In addition, a resistor could be connected between the transistors Q1 and Q2.

Having thus described one particular embodiment of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is not intended as limiting. The invention is limited only as defined in the following claims and the equivalents thereto.

What is claimed is:

1. A monolithically integrated voltage reference circuit comprising a first transistor and a second transistor, each transistor having a first terminal, a second terminal and a control terminal, a first constant current generator and a second constant current generator, and a first resistor and a second resistor connected in series to each other and between the first terminal of the first transistor and, a first terminal of a voltage supply generator, the first terminal of the second transistor being connected to a link node between the two resistors, the first constant current generator being connected between a second terminal of the voltage supply generator and the second terminal of the first transistor, the second constant current generator being connected between the second terminal of the voltage supply generator and the second terminal of the second transistor, and the control terminal of the first transistor being connected to the control terminal of the second transistor, wherein a configuration of at least one of said first transistor and said second transistor is programmable.

2. A voltage reference circuit according to claim 1, wherein the first transistor and the second transistor are bipolar, and a configuration of an emitter region of at least one of said first and second transistors is programmable.

3. A voltage reference circuit according to claim 2, further including a third resistor connected between the control terminals of the first transistor and the second transistor.

4. A voltage reference circuit according to claim 3, wherein the emitter region of at least one of said first transistor and second transistor includes a plurality of discrete portions adapted to be connected electrically together in a predetermined fashion.

5. A voltage reference circuit according to claim 4 wherein the constant current generators are legs of a current mirror circuit structure.

6. A monolithically integrated voltage regulator of a type which comprises a polarization circuit with a bandgap reference, wherein said bandgap reference is a circuit according to claim 5.

7. A voltage reference circuit according to claim 1 wherein the constant current generators are legs of a current mirror circuit structure.

8. A monolithically integrated voltage regulator of a type which comprises a polarization circuit with a bandgap reference, wherein said bandgap reference is a circuit according to claim 7.

9. A monolithically integrated voltage regulator of a type which comprises a polarization circuit with a bandgap reference, wherein said bandgap reference is a circuit as claimed in claim 1.

10. A monolithically integrated voltage reference circuit comprising a first transistor and second transistor, each transistor having a first terminal, a second terminal and a control terminal, a first constant current generator and a second constant current generator, and a first resistor and a second resistor connected in series to each other and between the first terminal of the first transistor and a first terminal of a voltage supply generator, the first terminal of the second transistor being connected to a link node between the two resistors, the first constant current generator being connected between a second terminal of the voltage supply generator and the second terminal of the first transistor, the second constant current generator being connected between the second terminal of the voltage supply generator and the second terminal of the second transistor, and the control terminal of the first transistor being connected to the control terminal of the second transistor, wherein the first constant current generator and the second constant current generator respectively comprise a third transistor and a fourth transistor respectively connected to the first transistor and the second transistor, and that a configuration of at least one of said third transistor and said fourth transistor is programmable.

11. A voltage reference circuit according to claim 10, wherein the third transistor and the fourth transistor are bipolar, and a configuration of an emitter region of at least one of said third transistor and said fourth transistor is programmable.

12. A bandgap reference circuit for providing an output voltage at a predetermined value, comprising:

a first means for controlling a current;

a second means for controlling a current, each means for controlling a current having means for programming current flow according to an input voltage;

means for supplying current to supply a first current to the first means for controlling a current, and a second current to the second means for controlling a current, the means for supplying current being contructed and arranged to substantially match one of the first current and the second current to the other current; and means for outputting a voltage in response to an input current; wherein the means for outputting a voltage receives the input current from the second means for controlling a current according to the input voltage.

13. A bandgap reference circuit according to claim 12, wherein each means for controlling a current includes a transistor, and each means for programming includes an emitter area of the transistor having a size determining an amount of current flow for a predetermined input voltage.

14. A bandgap reference circuit according to claim 13, wherein the means for outputting a voltage includes a connection between the means for supplying current and the second means for controlling a current, for receiving the input current, and an amplifiying stage for providing the output voltage according to the input current;

the second current supplied by the means for supplying current being divided into a third current flowing into the second means for controlling a current, and the input current.

15. A bandgap reference circuit according to claim 13, wherein the means for supplying current includes a current mirror having at least two transistors, each transistor having a control gate interconnected with the control gate of the other transistor.

16. A bandgap reference circuit according to claim 15, wherein each transistor of the current mirror has a programmable emitter portion enabling the output voltage to be increased and decreased.

17. A bandgap reference circuit according to claim 13 further including a ratio of the size of emitter area of the second transistor to the size of the emitter area of the first transistor wherein the output voltage is increased and decreased when the ratio is increased and decreased, respectively, by changing the size of at least one emitter area.

18. A bandgap reference circuit according to claim 13 wherein the emitter area of at least one of the transistors includes a plurality of discrete portions constructed and arranged to be connected electrically together in a predetermined fashion.

19. A bandgap reference circuit for providing an output voltage at a predetermined value, comprising:

a first transistor for controlling a current;

a second transistor for controlling a current, each transistor having a programmable emitter portion having a size determining an amount of current flow for a predetermined input voltage;

a current supply stage for supplying a first current to the first transistor, and a second current to the second transistor to substantially match one of the first current and the second current to the other current; and a voltage output stage for providing the output voltage in response to an input current; wherein the voltage output stage receives the input current from the second transistor according to the input voltage.

20. A bandgap reference circuit according to claim 19, wherein the voltage output stage includes a connection between the current supply stage and the second transistor, for receiving the input current, and an amplifiying stage for providing the output voltage according to the input current;

the second current supplied by the current supply stage being divided into a third current flowing into the second transistor, and the input current.

21. A bandgap reference circuit according to claim 19, wherein the current supply stage includes a current mirror having at least two transistors, each transistor having a control gate interconnected with the control gate of the other transistor.

22. A bandgap reference circuit according to claim 21, wherein each transistor of the current mirror has a programmable emitter portion enabling the output voltage to be increased and decreased.

23. A bandgap reference circuit according to claim 19 wherein the emitter area of at least one of the transistors includes a plurality of discrete portions constructed and arranged to be connected electrically together in a predetermined fashion.

24. A bandgap reference circuit according to claim 23 further including a ratio of the size of emitter area of the second transistor to the size of the emitter area of the first transistor wherein the output voltage is increased and decreased when the ratio is increased and decreased, respectively, by changing the size of at least one emitter area.

25. A method for providing an output voltage at a predetermined value, comprising the steps of:

supplying a first current to a first transistor including a predetermined emitter area having a size determining an amount of current flow for a predetermined input voltage;

supplying a second current to a second transistor the second current substantially equalling the first current, the second transistor including a predetermined emitter area having a size determining an amount of current flow for the predetermined input voltage;

dividing the second current into a third current and an input current by allowing the third current to flow through the transistor, the excess being the input current;

outputting a voltage in response to the input current.

26. A method according to claim 25, further including the step of initially connecting a plurality of discrete portions of emitter area electrically together in a predetermined fashion.

27. A method according to claim 25 further including determining a ratio of the size of emitter area of the second transistor to the size of the emitter area of the first transistor wherein the output voltage is increased and decreased when the ratio is increased and decreased, respectively, by changing the size of at least one emitter area.

28. A method according to claim 25, further including the step of increasing the size of the emitter area of one of the transistors to change the output voltage.

29. A method according to claim 25, further including the step of decreasing the size of the emitter area of one of the transistors to change the output voltage.

30. A voltage regulator comprising:

a voltage supply having a first terminal and a second terminal;

a reference including a first transistor and a second transistor, each transistor having a first terminal, a second terminal and a control terminal;

a first constant current generator, a second constant current generator, a first resistor and a second resistor connected in series to each other and between the first terminal of the first transistor and a first terminal of the voltage supply, the first terminal of the second transistor being connected to a link node between the two resistors, the first constant current generator being connected between a second terminal of the voltage supply and the second terminal of the first transistor, the second constant current generator being connected between the second terminal of the voltage supply and the second terminal of the second transistor, and the control terminal of the first transistor being connected to the control terminal of the second transistor, wherein a configuration of at least one of said first and second transistors is programmable.

* * * * *